US008353240B1

(12) United States Patent
Schaedler et al.

(10) Patent No.: US 8,353,240 B1
(45) Date of Patent: Jan. 15, 2013

(54) COMPRESSIBLE FLUID FILLED MICRO-TRUSS FOR ENERGY ABSORPTION

(75) Inventors: Tobias A. Schaedler, Santa Monica, CA (US); Alan J. Jacobsen, Woodland Hills, CA (US); William Carter, Calabasas, CA (US); Yu Qiao, San Diego, CA (US)

(73) Assignees: HRL Laboratories, LLC, Malibu, CA (US); Regents of the University of CA, Oakland, CA (US)

( * ) Notice: Subject to any disclaimer, the term of this patent is extended or adjusted under 35 U.S.C. 154(b) by 137 days.

(21) Appl. No.: 12/928,947

(22) Filed: Dec. 22, 2010

(51) Int. Cl.
*F41H 5/02* (2006.01)
*F41H 1/00* (2006.01)

(52) U.S. Cl. ..... 89/36.02; 89/36.05; 89/920; 89/921

(58) Field of Classification Search ..... 89/36.02, 89/36.05, 920, 921, 922, 923; 2/2.5
See application file for complete search history.

(56) References Cited

U.S. PATENT DOCUMENTS

| | | | | |
|---|---|---|---|---|
| 8,057,594 | B2 * | 11/2011 | Doyoyo et al. | 106/679 |
| 2010/0016460 | A1 | 1/2010 | Qiao | |
| 2010/0101402 | A1 * | 4/2010 | Ma | 89/36.02 |

FOREIGN PATENT DOCUMENTS

| | | | |
|---|---|---|---|
| WO | WO 2007/022456 | A2 | 2/2007 |
| WO | WO 2007/044030 | A2 | 4/2007 |
| WO | WO 2007/044030 | A3 | 4/2007 |
| WO | WO 2008/054356 | A2 | 5/2008 |

OTHER PUBLICATIONS

Dalla Torre, F., et al., "Nanocrystalline electrodeposited Ni: microstructure and tensile properties", *Acta Materialia*, vol. 50 (2002), pp. 3957-3970.
Deshpande, V.S., et al., "Constitutive model for predicting dynamic interactions between soil ejecta and structural panels", *Journal of the Mechanics and Physics of Solids*, vol. 57 (2009), pp. 1139-1164.
Dharmasena, K.P., et al., "Mechanical response of metallic honeycomb sandwich panel structures to high-intensity dynamic loading", *International Journal of Impact Engineering*, vol. 35 (2008), pp. 1063-1074.

(Continued)

*Primary Examiner* — Stephen M Johnson
(74) *Attorney, Agent, or Firm* — Christie, Parker & Hale, LLP

(57) ABSTRACT

A kinetic energy and blast energy absorbing material includes: a micro-truss structure including: a plurality of first struts extending along a first direction; a plurality of second struts extending along a second direction; and a plurality of third struts extending along a third direction; and a compressible fluid comprising a liquid or gel and a nanoporous material, wherein the micro-truss structure contains the compressible fluid.

30 Claims, 16 Drawing Sheets
(4 of 16 Drawing Sheet(s) Filed in Color)

OTHER PUBLICATIONS

Evans, A.G., et al., "Concepts for enhanced energy absorption using hollow micro-lattices", Article in Press—*International Journal of Impact Engineering*, (2010), doi: 10.1016/j.ijimpeng.2010.03.007, pp. 1-13.

Han., A., et al., "Pressure-Induced Infiltration of Aqueous Solutions of Multiple Promoters in a Nanoporous Silica", *J. Am. Chem. Soc.,* vol. 128 (2006), pp. 10348-10349.

Han, A., et al., "Effects of surface treatment of MCM-41 on motions of confined liquids", *Journal of Physics D: Applied Physics*, vol. 40 (2007), pp. 5743-5746.

Jacobsen, A.J., et al., "Compression behavior of micro-scale truss structures formed from self-propagating polymer waveguides", *Acta Materialia*, vol. 55 (2007), pp. 6724-6733.

Surani, F.B., et al., "Energy absorption of a nanoporous system subjected to dynamic loadings", *Applied Physics Letters*, vol. 87 (2005), pp. 163111-1-163111-3.

Surani, F.B., et al., "An energy-absorbing polyelectrolyte gel matrix composite material", *Composites: Part A*, vol. 37 (2006), pp. 1554-1556.

* cited by examiner

COMPRESSIBLE FLUID FILLED MICRO-TRUSS FOR ENERGY ABSORPTION

BACKGROUND

Cellular, or porous, materials have the ability to absorb significantly more energy than solid structures because of their ability to become denser (e.g., "densify") in response to impacts. As such, cellular materials such as metallic or ceramic foams have been proposed as an energy absorbing layer in armor-type systems. However, the random microstructure of these materials severely diminishes their mechanical properties. The deformation of a cellular foam is dominated by the bending behavior of the cell struts. Simple mechanics dictates that bending dominated structures are less efficient in load carrying capacity than compression dominated behavior exemplified by a truss structure. Due this mechanical inefficiency, some fraction of the mass in the foam does not participate in energy absorption and represents added or parasitic weight.

U.S. Pat. Nos. 6,698,331 and 7,128,963, which are incorporated by reference herein in their entirety, propose blast protection material systems that incorporate random cellular ceramic or metallic foam as an energy absorbing layer. However, these patent disclosures do not provide an ordered micro-truss structure. The use of metallic lattice (truss) materials for energy absorbing application is discussed in U.S. Pat. No. 7,382,959 and U.S. patent application Ser. Nos. 11/801,908; 12/008,479; 12/074,727, 12/075,033, and 12/455,449 which are incorporated by reference herein in their entirety. Methods of manufacturing a micro-truss structure are described, for example, in U.S. patent application Ser. No. 12/455,449, which discloses a method of fabricating micro-truss structures having a fixed area, and 12/835,276, which discloses a method of continuously fabricating micro-truss structures according to a continuous process (e.g., a strip of arbitrary length), which are incorporated by reference herein in their entirety. However, there is still a demand for an impact or blast energy absorbing material that is light weight.

Compressible fluids have the ability to absorb a significant amount of energy. U.S. patent application Ser. No. 11/720,784, which is incorporated by reference herein in its entirety, describes a compressible fluid which may include a nanoporous material immersed in a non-wetting liquid which is compressed when external forces push the liquid into the nanopores of the material.

An explosive blast typically comprises an air pressure wave characterized by an overpressure $P_0$ in excess of the ambient pressure $P_a$ (and where $P_0/e$ and $t_i$ indicate that the pressure drops exponentially) with an associated impulse per unit area, as illustrated, e.g., in FIGS. 11*a* and 11*b*. In order for an intervening medium to protect a structure against the overpressure $P_0$, the medium must reduce the pressure below the structure's damage threshold $\sigma_{th}$. This can be achieved by the intervening medium's undergoing a large volume decrease at a constant pressure, thereby extending the duration of the impulse.

The above information disclosed in this Background section is only for enhancement of understanding of the background of the invention and therefore it may contain information that does not form the prior art that is already known in this country to a person skilled in the art.

SUMMARY

Aspects of embodiments of the present invention relate to a micro-truss based structural apparatus with compressible fluid for absorbing energy from impacts or pressure waves (e.g., a fluidic micro-truss based impact or blast protection apparatus).

Aspects of embodiments of the present invention are directed toward a fluidic micro-truss based blast protection apparatus which is capable of absorbing energy from an impact or a pressure wave. Aspects of embodiments of the present invention are directed toward a fluidic micro-truss blast protection system which may be used as a component of personal armor, a component of vehicle armor (e.g., on a Humvee), or a component of a blast protection wall (e.g., a Bremer wall) in order to provide additional protection against collisions, projectiles (e.g., bullets), and blasts (e.g., from improvised explosive devices (IEDs)).

Aspects of embodiments of the present invention are also directed toward a fluidic micro-truss blast protection system which may be used on internal surfaces of a vehicle to provide additional protection for passengers.

According to embodiments of the present invention, polymer micro-truss structures, which are formed by interconnecting self-propagating polymer waveguides (or struts), are converted to lightweight, high-strength materials such as carbon, metals, ceramics, or polymers (e.g., high toughness polymers) or composites thereof, that are utilized by the micro-truss based protection apparatuses for high velocity impact or pressure wave applications. According to embodiments of the present invention, these micro-truss structures are combined with a compressible fluid, e.g., a suspension of nanoporous particles in a liquid or gel (which may be referred to as a "nanoporous-materials-functionalized (NMF) fluid"), to provide additional energy absorbing characteristics.

According to one embodiment of the present invention, a kinetic energy and blast energy absorbing material includes: a micro-truss structure including: a plurality of first struts extending along a first direction; a plurality of second struts extending along a second direction; and a plurality of third struts extending along a third direction; and a compressible fluid comprising a liquid or gel and a nanoporous material, wherein the micro-truss structure contains the compressible fluid.

The compressible fluid may be a compressible nano-porous materials functionalized (NMF) fluid. The NMF fluid may be a liquid or a gel. The NMF fluid may include a nanoporous material and an infiltration fluid, wherein the infiltration fluid is nonwetting to the nanoporous material. The nanoporous particles may be silica based nanoporous particles. The nanoporous particles may be a hydrophobic zeolite. The nanoporous particles may be a nanoporous carbon. The nanoporous carbon may be a mercaptohexadecanoic acid (MHA) treated nanoporous carbon.

The nanoporous particles may have a surface area at 100 $m^2/g$ or 2000 $m^2/g$ or between 100 $m^2/g$ and 2000 $m^2/g$.

The infiltration fluid may include water, an aqueous solution of electrolytes, a viscous liquid, a liquid metal, a gel, a polymer, or a combination thereof.

The struts of the kinetic energy and blast energy absorbing material may be hollow.

The compressible fluid may be located within the hollow struts.

Each of the hollow struts may have a diameter from 10 microns to 10 mm.

A wall of each of the struts may have a thickness from 1 micron to 1 mm.

The compressible fluid may be located between the struts.

The kinetic energy and blast absorbing material may be configured to be part of a protective piece of clothing.

The kinetic energy and blast energy absorbing material may be configured to be part of a wall of a building.

The first, second, and third struts may include a metal. The metal may be nickel, aluminum, titanium, steel, or alloys thereof.

The first, second, and third struts may include a polymer. The polymer may be a polycarbonate, an aramid, a high impact polystyrene, a nylon, an ultra-high molecular weight polyethylene, and combinations thereof.

The micro-truss structure may fill 0.5% to 30% of a volume of the material and the NMF fluid may fill 5% to 95% of the volume.

The first, second, and third directions may be at a first angle between 45° and 70° with respect to a facesheet attached to a plurality of first ends of the first, second, and third struts.

The kinetic energy and blast absorbing material may further include a plurality of fourth struts extending in a fourth direction substantially perpendicular with respect to a facesheet attached to a plurality of first ends of the first, second, and third struts.

The plurality of first, second, third and fourth struts may be hollow and may comprise metal and the first, second, third and fourth struts may each have a diameter of 2 mm and a wall thickness of 0.1 mm, wherein the micro-truss structure has a unit cell height of 15 mm, wherein each of the first, second, and third directions is at an angle of 60° with respect to the facesheet, wherein the compressible fluid may be an aqueous suspension of 40% by weight hydrophobic nanoporous silica gel and may be located within the hollow portions of plurality of first, second, third and fourth struts, and wherein the micro-truss structure may fill 5% of the volume of the kinetic energy and blast energy absorbing material and the compressible fluid may fill 25% of the volume of the kinetic energy and blast energy absorbing material.

The plurality of first, second, third and fourth struts may be hollow and may comprise metal and the first, second, third and fourth struts may each have a diameter of 2 mm and a wall thickness of 0.1 mm, wherein the micro-truss structure has a unit cell height of 15 mm, wherein each of the first, second, and third directions is at an angle of 60° with respect to the facesheet, wherein the compressible fluid may be an aqueous suspension of 7% by weight hydrophobic nanoporous silica gel in polyacrylic acid gel and may be located within the hollow portions of plurality of first, second, third and fourth struts, and wherein the micro-truss structure may fill 5% of the volume of the kinetic energy and blast energy absorbing material and the compressible fluid may fill 25% of the volume of the kinetic energy and blast energy absorbing material.

The plurality of first, second, third, and fourth struts may be hollow and may comprise metal and the first, second, and third struts may each have a diameter of 1 mm and a wall thickness of 0.1 mm, wherein the micro-truss structure has a unit cell height of 10 mm, wherein each of the first, second, and third directions is at an angle of 60° with respect to the facesheet, wherein the compressible fluid may be an aqueous suspension of 7% by weight hydrophobic nanoporous silica gel and may be located within the open volume between the struts, and wherein the micro-truss structure may fill 5% of the volume of the kinetic energy and blast energy absorbing material and the compressible fluid may fill 85% of the volume of the kinetic energy and blast energy absorbing material.

The plurality of first, second, third and fourth struts may be hollow and may comprise metal and the first, second, third and fourth struts may each have a diameter of 1 mm and a wall thickness of 0.1 mm, wherein the micro-truss structure has a unit cell height of 10 mm, wherein each of the first, second, and third directions is at an angle of 60° with respect to the facesheet, wherein the compressible fluid may be an aqueous suspension of 7% by weight hydrophobic nanoporous silica gel in polyacrylic acid gel and may be located within the open volume between the struts, and wherein the micro-truss structure may fill 5% of the volume of the kinetic energy and blast energy absorbing material and the compressible fluid may fill 85% of the volume of the kinetic energy and blast energy absorbing material.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, together with the specification, illustrate exemplary embodiments of the present invention, and, together with the description, serve to explain the principles of the present invention.

DETAILED DESCRIPTION

Figure 1:
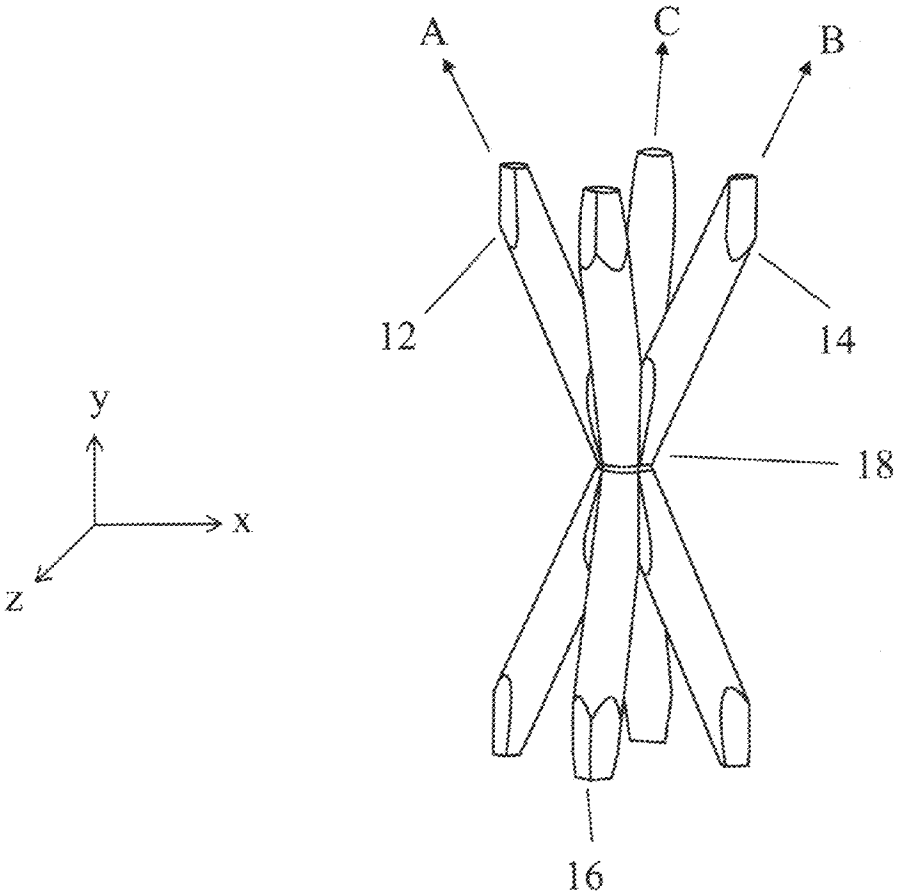
FIG. 1 is a perspective view of a portion of an ordered 3D micro-truss structure according to aspects of the present invention.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

In the context of embodiments of the present invention, a three-dimensional ordered microstructure is referred to as an ordered three-dimensional structure having order at the micrometer scale.

Embodiments of the present invention provide fluidic micro-truss based blast protection apparatuses that utilize micro-truss materials together with a compressible fluid (e.g., a nanoporous material functionalized (NMF) fluid), which can function as both a structural and an energy absorbing layer. In the field of chemical functional porous materials, nanoporous refer to a class of porous materials having pore-diameters between 1 and 100 nm. For most functional applications, pore sizes normally do not exceed 100 nm. It is noted that nanoporous materials actually encompass some microporous materials to all mesoporous materials.

Here, as envisioned in embodiments of the present invention, cellular, or porous, materials have the ability to absorb significantly more energy than solid structures because of their ability to become more dense (e.g., "densify") in response to impacts or pressure waves. Cellular materials such as metallic or ceramic foams have been proposed as an energy absorbing layer in armor-type systems; however, the random microstructure of these materials severely diminishes their mechanical properties. When compared with structures having random openings or pores, the long range ordered structure of the micro-truss materials exhibit greatly improved strength per unit weight. This increased specific strength allows for structures having the same strength as random porous materials with less weight and greater open volumes, thus increasing their ability to densify and therefore providing improved blast protection. However, localized mechanical and/or thermal softening effects associated with the deformation mechanism (e.g., shear banding and buckling) can limit the effectiveness of the energy absorption process. Furthermore cellular materials have a relatively slow response time.

According to one embodiment of the present invention, a compressible NMF fluid includes nanoporous particles suspended in a nonwetting liquid or gel. Upon external pressure of a blast wave, the liquid or gel is forced into the nanopores and a significant amount of energy is dissipated by capillary resistance and molecular friction. The nanopore surface must be nonwettable to the liquid, so that the nanopores remain empty at rest. As the liquid is forced into the pores by an external pressure, the nanopore surface comes into contact with liquid molecules and the system's free energy increases by $E=\Delta\gamma*A$, where $\Delta\gamma$ is the excess solid-liquid interfacial tension and A the specific surface area. The high surface area of nanoporous particles (e.g. 100-2000 $m^2/g$) is leveraged to absorb 10 to 150 J/g energy during forced infiltration of the nonwetting liquid into the nanopores. For example, if the host fluid is water the surface of the nanopores must be hydrophobic, or if the host fluid is nonaqueous the surface of the nanopores must be lyophobic. According to one embodiment of the present invention, every gram of nanoporous particles contains $10^{20}$ to $10^{24}$ pores, which act as "dashpot-like" energy absorbers and can absorb 10 to 150 J/g in a single loading cycle.

Aspects of embodiments of the present invention are directed toward the synergetic combination of an NMF fluid with a cellular material such as a micro-truss structure, which can provide improved absorption of and protection from blast energy or kinetic energy (e.g., from a projectile or other impact) by, for example, reducing the blast wave peak due to the ultra-fast response time of NMF fluids (e.g., 1-3 μsec) followed by bulk energy absorption in the fluidic micro-truss structure, spatially spreading energy to larger areas through the compressible NMF fluids, thus countering local attacks with a global response, maximum exploitation of energy absorption potential of micro-truss structures by utilizing NMF fluids to preference the buckling modes with the highest energy dissipation and distribute the dynamic load, preventing damage localization (e.g., shear banding).

Figure 2:
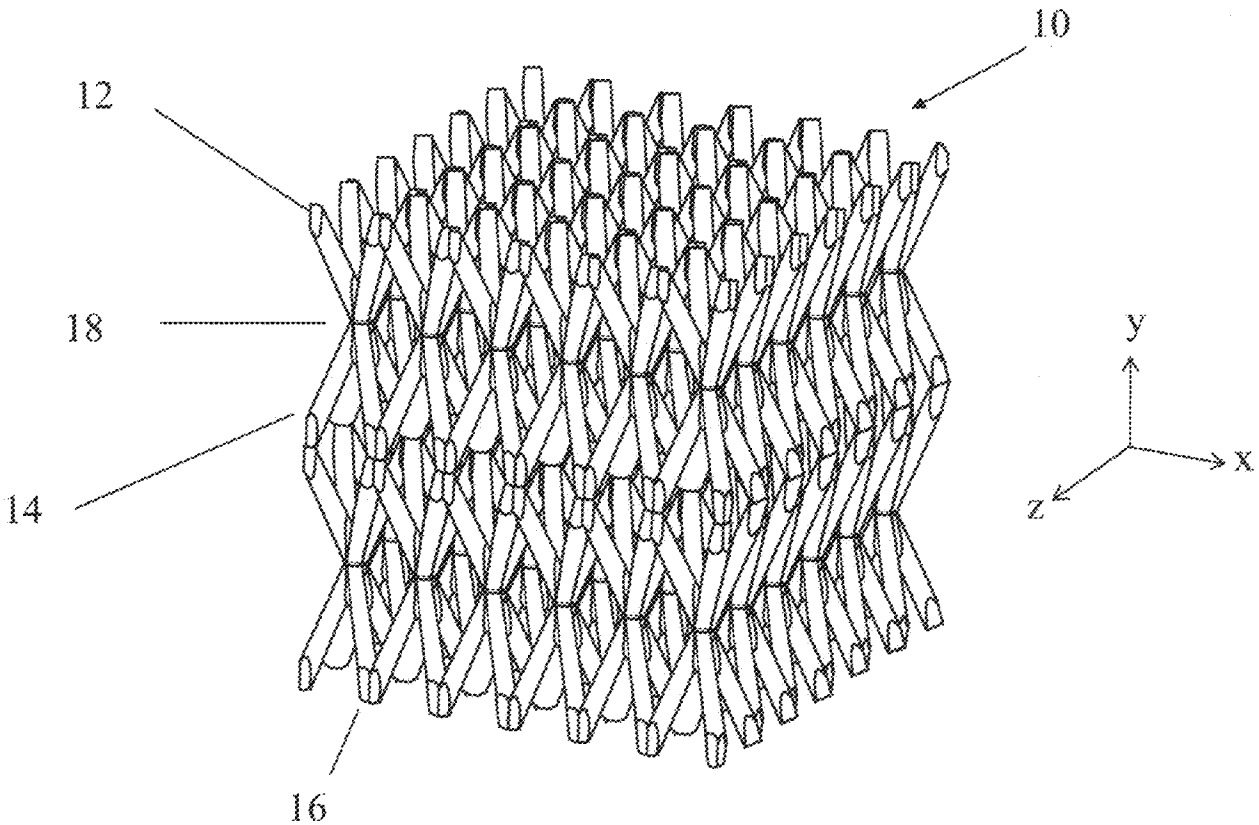
FIG. 2 is a perspective view of an ordered 3D micro-truss structure according to aspects of the present invention.

Referring to FIGS. 1 and 2, a three-dimensional ordered open-cellular microstructure 10 according to an embodiment of the present invention is a self-supporting structure. In one embodiment of the present invention, this three-dimensional ordered open-cellular micro-truss 10 can be utilized or modified for use in a fluidic micro-truss based blast protection apparatus and/or to manufacture the fluidic micro-truss based blast protection apparatus. The micro-truss 10 includes a plurality of struts (or truss elements) including first struts 12, second struts 14, and third struts 16, which extend along a first direction A, a second direction B, and a third direction C, respectively. With reference to FIGS. 1 and 2, the first, second, and third struts 12, 14, 16 interpenetrate each other at nodes 18 to form a continuous material with a three-dimensional microstructure order.

In one embodiment, the struts 12, 14, 16 include a photopolymer material. In one embodiment, the struts 12, 14, 16 are polymer optical waveguides.

In one embodiment, the continuous material is continuously formed such that it lacks any interior boundaries, e.g., boundaries within the interpenetrating portions of struts 12, 14, 16. In another embodiment, each node 18 of the micro-truss 10 is formed of the continuous material.

According to one embodiment of the present invention, the micro-truss 10 is formed by using a fixed light input (collimated UV light) to cure (polymerize) polymer optical waveguides, which can self-propagate in a 3D pattern. As such, the propagated polymer optical waveguides form the micro-truss 10.

As disclosed in Monro et al. "Topical Review Catching Light In Its Own Trap," Journal Of Modern Optics, 2001, Vol. 48, No. 2, 191-238, which is incorporated by reference herein in its entirety, some liquid polymers, referred to as photopolymers, undergo a refractive index change during the polymerization process. The refractive index change can lead to a formation of polymer optical waveguides. If a monomer that is photo-sensitive is exposed to light (typically UV) under the right conditions, the initial area of polymerization, such as a small circular area, will "trap" the light and guide it to the tip of the polymerized region, further advancing that polymerized region. This process will continue, leading to the formation of a waveguide structure with approximately the same cross-sectional dimensions along its entire length.

According to one embodiment of the present invention, a moving mask with a two-dimensional pattern of apertures 340 (see FIGS. 4*a* and 4*b*) is used with a light source and photo-monomer to create an ordered 3D polymer micro-truss structure (or an open-cell polymer micro-truss structure).

Figure 3A:
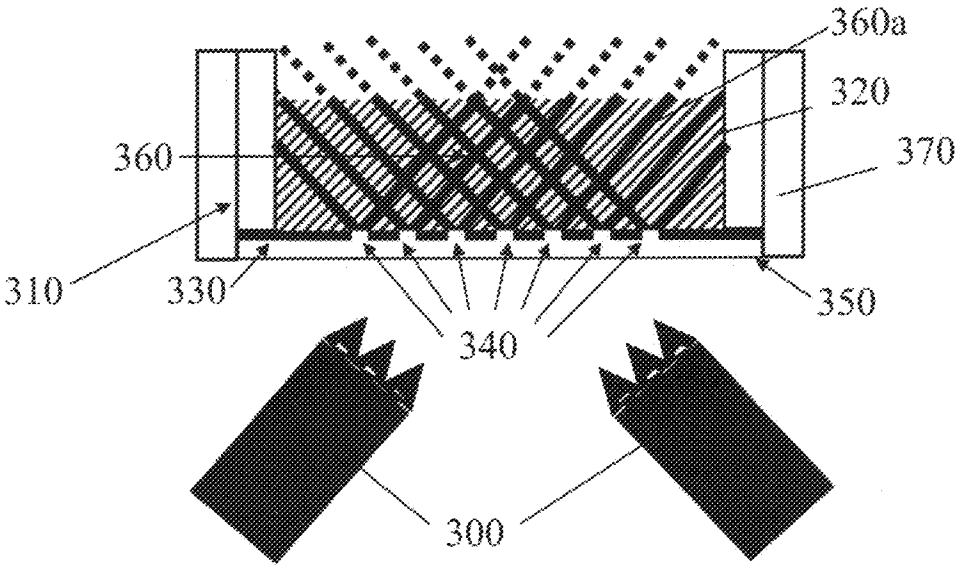
FIG. 3*a* is a schematic cross-sectional diagram at an exposure area of a channel of a system for forming a structure from multiple waveguides created using a single collimated beam or multiple collimated beams passing through multiple apertures located at the bottom of the channel.

FIG. 3*a* is a schematic cross-sectional diagram of a continuous process for forming a structure of unlimited length from multiple waveguides created using a single collimated beam or multiple collimated beams passing through multiple apertures located at the bottom of the channel. With reference to FIG. 3*a*, a system for forming an ordered 3D polymer micro-truss structure according to an embodiment of the present invention includes one or more collimated light sources 300, a channel/mold 310 having (or containing) photo-monomer 320 that will polymerize at a wavelength of collimated light beams provided by the light sources 300, and a patterning apparatus, such as a mask 330 with one or more apertures (open areas) 340. Each of the apertures 340 has a given shape and dimension substantially matching a cross-sectional geometry of a waveguide (e.g. waveguide 360*a*).

Continuing with FIG. 3*a*, the mask 330 rests, without attachment, on the transparent substrate (or transparent plate) 350 that includes the bottom of the channel/mold 310. In one embodiment, the mask 330 is made of a lightweight, flexible, and opaque material such as PET (polyethylene terephthalate) film. The transparent substrate 350 may be made of a material (such as quartz) that is transparent to the light emitted from the collimated light sources, such that the collimated light shines into an exposure area 410 of the channel (see, e.g., FIG. 4*c*). The photo-monomer 320 fills the channel 310 above the mask 330, and the weight of the photo-monomer 320 prevents or protects the mask 330 from bowing. In one embodiment, different thicknesses of micro-truss structures can be achieved by filling the channel (or mold) 310 with photo-monomer 320 to the desired height. Once the collimated light source is applied, the intersecting polymer waveguides 360*a* will grow upward from the surface of the mask 330, terminating at the free (e.g., upper) surface of the photo-monomer 320 in the channel 310. The mask 330 is configured to move in the channel 310 (e.g., out of the plane of FIG. 3*a*) to move the apertures 340, the photo-monomer 320, and the growing waveguides 360*a* through the exposure area.

Figure 4B:
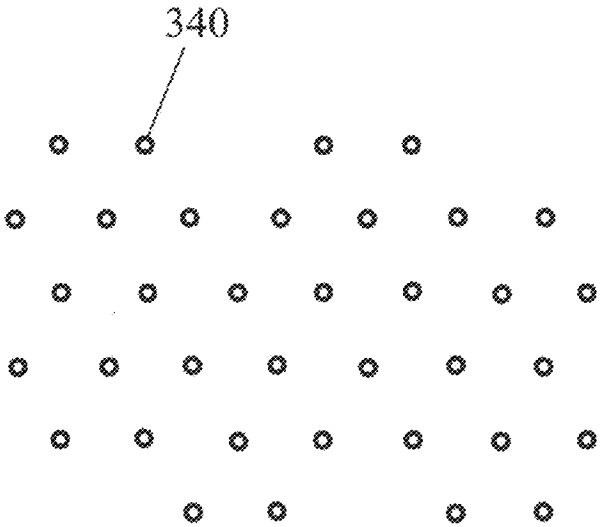
FIG. 4*b* illustrates a hexagonal mask pattern (or a hexagonal mask aperture pattern) according to an embodiment of the present invention.
Figure 4A:
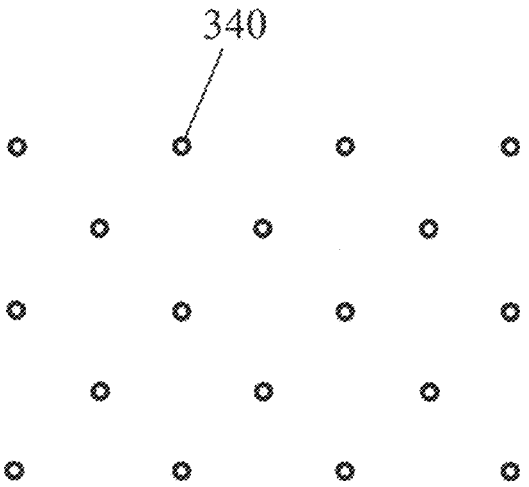
FIG. 4*a* illustrates a square mask pattern (or a square mask aperture pattern) according to an embodiment of the present invention.

Here, in FIG. 3*a*, a 3D network (or micro-truss structure 360) can be formed because the intersecting polymer waveguides 360*a* will polymerize together, but will not interfere with waveguide propagation. Also, the spacing between the plurality of waveguides 360*a* corresponds with the pattern of the plurality of apertures 340. The pattern of the apertures 340 may, for example, be in a square pattern as shown in FIG. 4*a* and/or in a hexagonal pattern as shown in FIG. 4*b*. The hole (aperture) spacing, i.e., distance between apertures 340 in the mask 330, and the number of waveguides 360 formed from each of the apertures 340 will determine the open volume fraction (i.e. open space) of the formed ordered 3D micro-truss structure (or the formed open-cell polymer micro-truss structure).

As such, using the system of FIG. 3*a*, an ordered 3D micro-truss structure 360 can be designed for various applications. The design parameters include: 1) the angle and pattern of the polymer waveguides with respect to one another, 2) the packing, or relative density of the resulting cell structure (or the open volume fraction), and 3) the cross-sectional shape and dimensions of the polymer waveguides. Here, in one embodiment, the waveguide (or micro-truss) diameter can range from 10 microns to 10 mm depending on the design criteria.

In one embodiment, the length of the waveguide between waveguide nodes of interpenetrating waveguides can be between 5 and 15 times the diameter. In addition, the number of nodes, or the number of repeating unit cells, through the thickness of the 3D micro-truss structure can be designed. A micro-truss structure may have ½ unit cell to 10 unit cells through its thickness. Moreover, the propagation distances and the size of the nodes of the interpenetrating waveguides are unperturbed by the change in the index of refraction caused by polymerization, due to the method of formation of the ordered 3D micro-truss structure (or the open-cell polymer micro-truss structure).

In one embodiment, first, second, and third directions in which first, second, and third waveguides respectively extend include first, second, and third angles, the first, second, and third angles having first, second, and third inclinations (e.g., with respect to the xz-plane as shown in FIGS. 1 and 2) and first, second, and third azimuths (e.g., about the y-axis as shown in FIGS. 1 and 2). In one embodiment, the first, second, and third inclinations each have the same or different values and each is in a range from 45° to 70° or between 80°-90° off the mask normal, inclusive.

Figure 6:
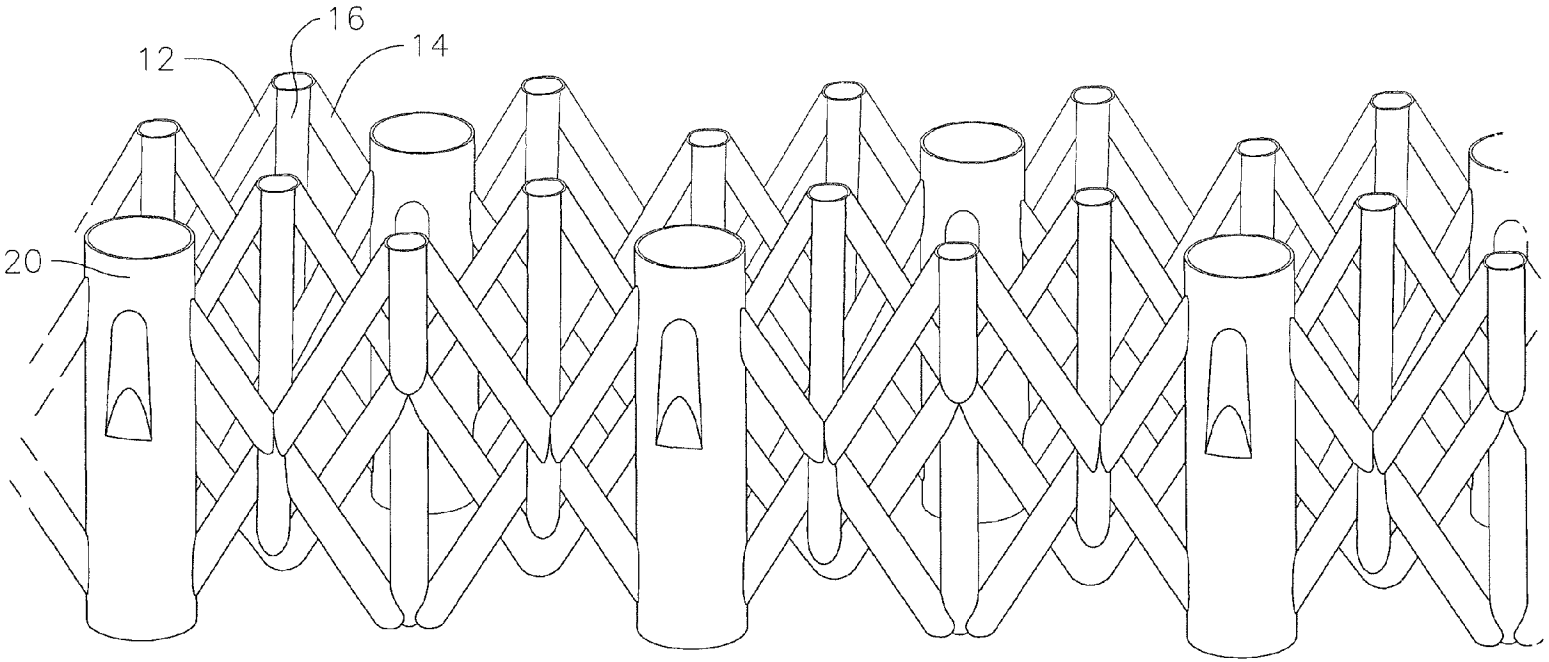
FIG. 6 is a photograph of a micro-truss structure according to one embodiment of the present invention.

According to one embodiment of the present invention, the waveguides may further include fourth waveguides extending in a fourth direction with an inclination of substantially 90° (e.g., substantially perpendicular to the xz-plane) (e.g., the 90° struts 20 in FIG. 6).

In some embodiments of the present invention, the micro-truss structure may be curved (e.g., the nodes 18 may lie along a curved surface) and the angles of inclination may be measured with respect to a plane tangent to the curved surface where the waveguide meets the surface.

According to one embodiment of the present invention, as illustrated in FIGS. 1 and 2, the struts 12, 14, 16 intersect at the nodes 18 to form symmetrical angles in three-dimensions (three orthogonal directions). The symmetrical angles relative to the xz-plane (see, FIG. 1), can measure between 0° and 90°. That is, struts 12, 14, 16 interpenetrate each other to form "perfect" nodes: each of the struts 12, 14, 16 defines an angle relative to a compression surface of the micro-truss 10 (e.g. a surface extending along a direction of the xz-plane), and the respective angles defined by the struts 12, 14, 16 are substantially equal to one another. However, embodiments of the present invention are not limited thereto.

Figure 5:
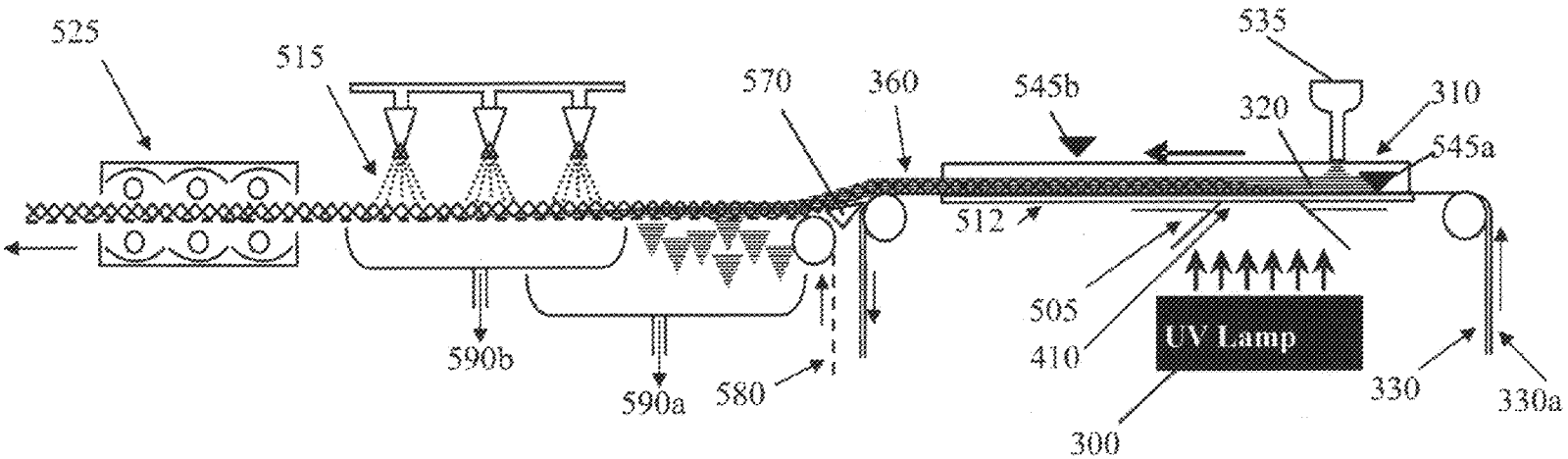
FIG. 5 is a schematic representation of a system for forming an ordered 3D micro-truss structure according to an embodiment of the present invention from multiple waveguides created using a single collimated beam or multiple collimated beams through multiple apertures and a moving mask.

With reference to FIG. 5, a system for forming a large area polymer micro-truss structure according to an embodiment of the present invention includes one or more collimated light sources 300 (for example and without implying a limitation, a UV collimated light source), a reservoir/mold channel (or a channel reservoir) 310 having open ends, and a mask 330 formed into a continuous loop. In one embodiment the light source 300 is combined with a mirror array 505 to direct light at controlled angles upward through the bottom of the mold channel 310 into an exposure area 410 (see, e.g., FIG. 4*c*). In some embodiments, the bottom of the mold channel 310 is a transparent material 512, such as quartz, which supports and provides a flat surface for the mask loop. In one embodiment, the sides of the mold channel 310 are made of an opaque material such as aluminum or polytetrafluoroethylene (PTFE). In one embodiment the mask 330 is made of a thin, lightweight, flexible film such as PET film, with a pattern printed on it. In some embodiments, the mask 330 is 5 to 10 mil (i.e., 0.005 to 0.010 inches) thick. In one embodiment the mask 330 is coated with an opaque material containing an array of apertures transparent to the wavelength of the collimated light sources 300.

Continuing with FIG. 5, in some embodiments the mask 330 is a continuous loop which is propelled on rollers around a circuit. In one embodiment a dispenser 535 dispenses premixed photo-monomer 320 onto the moving mask 330 at a controlled rate. The moving mask 330 carries the photo-monomer 320 across the exposure area 410 (in FIG. 4*c*) such that collimated light is applied continuously to the same parts of the growing polymer waveguides (e.g., 360*a*) and the photo-monomer 320 as it crosses the exposure area 410 to form the micro-truss structure 360. The depth of the photo-monomer 320 in the mold channel 310 can be controlled so that polymerized waveguides join to form a node at the top surface of the photo-monomer 320 in the mold channel 310. The beams of light from light sources 300 pass through the mask 330 to create a pattern of self-propagating, intersecting polymer waveguides that form an interconnected ordered 3D micro-truss structure 360 attached to the mask 330. Referring to FIG. 4*c*, the speed at which the moving mask 330 moves is selected such that the polymer waveguides are fully formed when the polymer waveguides exit the exposure area 410 (e.g., at the top of FIG. 4*c*). The speed of the moving mask 330 and the distance between the apertures 340 in a direction parallel with the direction of movement are designed or chosen such that the more fully polymerized waveguides corresponding to the apertures 340 in row X do not interfere with the polymerization of the less fully polymerized waveguides corresponding to apertures 340 in row Y. The limitations on the speed at which the mask 330 moves and the spacing of the apertures 340 may depend on the intensity of the light and the characteristics of the polymerization of the photo-monomer 320 being used.

In some embodiments, the micro-truss structure 360 is only weakly attached to the mask 330.

In another aspect of an embodiment, the system includes a removal device 570 at a point after the mold channel 310. For example, in FIG. 5 a knife-edged plate (or a plate having a sharp edge) 570 removes the newly-formed micro-truss structure 360 from the mask 330 at the point where the mask 330 makes a sharp turn. In one embodiment the micro-truss 360 is then transferred onto a porous conveyor belt 580 that supports and moves the micro-truss structure 360 downstream while draining away excess photo-monomer 320 into a basin 590*a*. In one embodiment the porous conveyor belt 580 is a perforated PET film substrate loop.

According to another embodiment of the present invention, the system includes a solvent that can be applied to the micro-truss structure 360 by any suitable mechanisms such as a spray 515 or a bath to clean the micro-truss structure 360. In one embodiment the waste solvent is collected in a basin 590*b* and recycled.

In one embodiment the system includes an ultraviolet curing oven 525 that uses high-intensity ultraviolet light and elevated temperatures to dry and post-cure the micro-truss structure 360.

According to another embodiment of the present invention, the system shown in FIG. 5 can be used to produce batches of micro-truss materials. In some embodiments the photo-monomer 320 is initially contained in the channel 310 by two flexible, squeegee-like dams 545*a* and 545*b* that are arranged to define a reservoir above the exposure area 410. In some embodiments the dams 545*a* and 545*b* are retractable to allow the formed micro-truss structure 360 to move downstream from the exposure area 410 (i.e., an area through which the photo-monomer 320 and the polymerized waveguides are exposed to the collimated beams). In this embodiment, after the micro-truss is formed within the mold/channel 310, dam 545*b* is lifted and the mask 330 is advanced until the micro-truss is at a point beyond the dam 545*b*. Dam 545*b* is then lowered and the reservoir is re-filled with photo-monomer 320; the process is repeated. The micro-truss structure 360 can thus be formed in batches.

According to some embodiments of both the continuous and batch processes, a clear or transparent (to the wavelength of the collimated lights 300) film substrate 330*a* such as PET is placed between the mask 330 and the photo-monomer 320. This transparent film substrate 330*a* moves in tandem with the mask 330 containing the mask pattern by, for example, the use of a film transport mechanism in which sprocket wheels engage registered perforations in the edges of the mask film 330 and the transparent film substrate 330*a*. In these embodiments, the transparent film substrate 330*a* would be the substrate from which the polymer waveguides grow, and the mask 330 would be spared the wear-and-tear resulting from the repeated removal of the micro-truss (e.g. by scraping with the knife-edged plate 570) and cleaning cycles (exposure to solvents, wiping, etc.). In some embodiments, the micro-truss is removed from this transparent film substrate 330*a* at the knife-edged plate 570 shown in FIG. 5, and in other embodiments it remains attached through the remainder of the cleaning and drying steps. In embodiments in which the micro-truss remains attached to the clear transparent film substrate 330*a* during the cleaning and drying steps, the clear transparent film substrate 330*a*, together with the attached micro-truss, may be rotated (e.g., by 90 to 180 degrees) and the orientation of the solvent spray heads (515) adjusted accordingly in order to improve the draining and cleaning of the micro-truss.

Figure 3B:
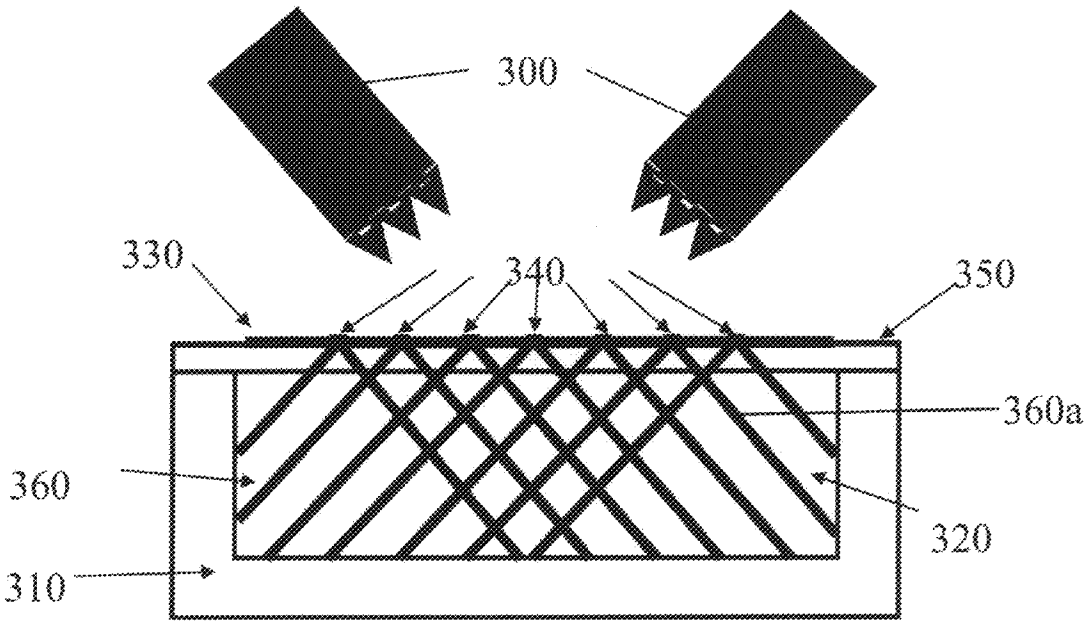
FIG. 3*b* is a schematic cross-sectional diagram at an exposure area of a channel of a system similar to that of FIG. 3*a*, but where the collimated beam or beams pass through multiple apertures located above the channel.

In some embodiments, the collimated light sources 300 and the mask 330 may be located above the channel (see, e.g., FIG. 3*b*) or at either side 370 of the channel (see FIG. 3*a*). In these embodiments, the exposure area 410 would still be bound by the collimated light sources 300 and the mask 330. In some embodiments, the photo-monomer 320 would be supported by a film substrate 330*a* such as PET placed between the photo-monomer 320 and the bottom of the channel. The film substrate 330*a* moves in tandem with the mask 330 in order to move the photo-monomer 320 across the exposure area 410.

According to another embodiment of the present invention, the micro-truss can be fabricated using a static process (e.g., without a moving mask or conveyer belt) which fabricates micro-truss structures approximately the same size as that of the mask as described, for example, in U.S. patent application Ser. No. 12/455,449.

According to one embodiment of the present invention, the polymer waveguides (or struts) are coated with a ductile or malleable material to improve the energy absorbing properties and to reduce the brittleness of the micro-truss structure. Also in a further embodiment of the present invention, base elements of a cellular structure are coated with a material different from the material of the cellular structural itself, and the base elements are removed to create a self-supporting structure having continuous but separated volumes.

A stronger, hollow micro-truss structure may be fabricated using the polymer micro-truss structure by coating the polymer micro-truss structure with a different material and then removing the underlying polymer waveguides. Relevant materials include metals (through electrodeposition), ceramic materials (through slurry coating), and alternative polymers (through dip casting or chemical vapor deposition (CVD)).

In one embodiment of the present invention, the polymer micro-truss structure may be coated with a metal such as nickel, aluminum, titanium, steel, and alloys thereof. Electrodeposition, slurry deposition, physical vapor deposition (PVD), or chemical vapor deposition (CVD) may be used to coat the polymer micro-truss structure. The polymer micro-truss structure can then be removed by burning or etching using a strong base, leaving a hollow, metal micro-truss structure. According to one embodiment of the present invention, each of the hollow metal struts may have an inner diameter in the range of 10 microns to 10 mm and the thickness of the metal (or the wall thickness) is in the range of 1 micron to 1 mm. The resulting metal micro-truss structure may have a relative density in the range 0.5% to 30% with respect to a solid metal block.

In one embodiment the polymer micro-truss can be converted to vitreous carbon by vacuum heat treatment(s) and can be subsequently coated with SiC, niobium or diamond using a high temperature coating process such as CVD.

Also, in one embodiment, a brittle micro-truss material, such as vitreous carbon, can be configured to absorb energy after initial fracture, by coating the vitreous carbon with one or more ductile materials to prevent (or protect from) catastrophic failure, and to enable additional absorption of energy through plastic deformation.

In some embodiments of the present invention, the materials include polymer materials with a high strain to failure such as aramids, polycarbonates, high impact polystyrene, nylons, ultra-high molecular weight polyethylene, and similar materials. Such materials may be formed on the polymer micro-truss using dip coating, spray coating, or CVD.

Additional improvements in compression strength may be realized through architectural optimization. Architectural optimization refers to trading off unit cell design, truss element diameter, length, angles, number of truss elements per unit cell and materials to achieve a desired densification from an impact or pressure wave.

As discussed above, according to some embodiments of the present invention, the micro-truss structure includes struts extending in a fourth direction substantially perpendicular to the xz-plane.

Figure 7:
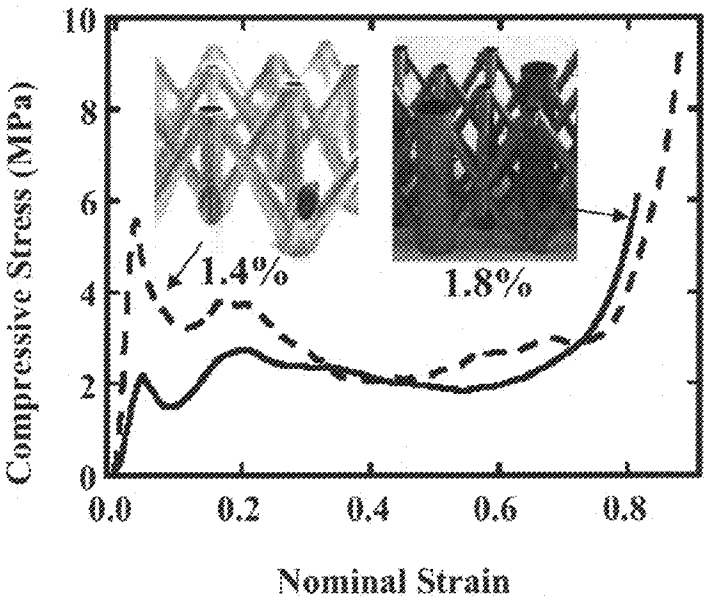
FIG. 7 is a graph comparing compressive stress as a function of nominal strain for micro-truss structures with and without 90° truss members (as depicted) having relative densities of 1.8% and 1.4% respectively, according to one embodiment of the present invention.

FIG. 7 is a graph comparing compressive stress in megapascals (MPa) as a function of the nominal strain on a truss for a metal micro-truss structure having only hollow struts at 60° (dotted line) according to one embodiment of the present invention and hollow struts at 60° along with 90° struts according to another embodiment of the present invention, as discussed above (solid line). During compression, the 90° struts are deformed through local buckling, resulting in a more ideal, plateau-like response and the reduction of the initial peak at a nominal strain of about 0.05 from almost 6 MPa in the structure without the 90° struts to about 2 MPa.

According to one embodiment of the present invention, an NMF fluid is used to improve the blast protection capability of a hollow micro-truss material, by reducing the blast wave peak due to the ultra-fast response time of NMF fluids, by spatially spreading energy to larger areas through the compressible NMF fluids, thus countering local attacks with a global response, by preferring the buckling modes with the highest energy dissipation, thereby better exploiting the energy absorption potential of micro-truss structures, and by distributing the dynamic load, preventing damage localization (e.g., shear banding).

An NMF fluid includes nanoporous particles suspended in a nonwetting infiltration fluid (e.g., a liquid or a gel) and are described in further detail in, for example, U.S. patent application Ser. No. 11/720,784. According to embodiments of the present invention, "nonwetting" in this context means that intermolecular forces (e.g., hydrophobic effects) cause the nonwetting infiltration fluid to be repelled from the nanopores of the nanoporous particles when the NMF fluid is not subject to external forces. As described above, upon external pressure of a blast wave, the infiltration fluid is forced into the nanopores and a significant amount of energy is dissipated by the capillary and viscous effects over the large nanopores surface area (e.g. 100 to 2000 $m^2/g$). According to one embodiment of the present invention, every gram of nanoporous particles contains $10^{20}$ to $10^{24}$ pores that act as "dashpot-like" energy absorbers and can absorb 10 to 150 J/g in a single loading cycle (e.g., the liquid being forced into the nanopores).

Examples of nanoporous materials that may be used in the NMF fluid include silicas, carbons, zeolites, and similar materials. The nanoporous materials may be treated by chemical etching, ion exchange, grafting, etc. Examples of infiltration liquids that may be used in the NMF fluid include pure water, aqueous solutions of electrolytes (e.g., sodium chloride), viscous liquids (e.g., glycerin), liquid metals (e.g. mercury), gels, soft matter (e.g., polymers), alcohol (e.g., ethanol, propanols, butanols, pentanols, hexanols, and heptanols), tetrahydrofuran, dimethyl sulfoxide, mineral oils, glycols, and the like.

In embodiments of the present invention, the liquid is nonwetting For example, in one embodiment of the present invention, water is used as the liquid or gel and MCM-41 (Mobil Composition of Matter No. 41) (treated with toluene and chlorotrimethylsilane to make the amorphous silica of the pore walls of the MCM-41 hydrophobic) is used as the nanoporous material. In another embodiment, the liquid may be a solution of sodium chloride and the nanoporous material may be a zeolite. In still another embodiment, a water-glycerin mixture is used with a silica-based hydrophobic nanoporous material. In a further embodiment, nanoporous carbon particles are suspended in polypropylene or mercury and the nanoporous carbon particles may be mercaptohexadecanoic acid (MHA) treated nanoporous carbon.

The working pressures of NMF fluids relate to properties of the nanoporous materials (e.g., framework material, pore size distribution, and pore structure), properties of the liquid component (e.g., the solvent, the solute, and the viscosity of the liquid), and surface properties of the material (e.g., surface treatment procedures and the density of surface defects). The compressibility of the NMF fluid can also be adjusted by varying the proportion of the fluid that is made up of the nanoporous material. The presence of a promoter (e.g., alkyl alcohols, sulfur acids and salts thereof, quaternary amines, alkali metals, alkaline earth metals, polyols, carbohydrates, fats, fatty acids, fatty acid amides, carboxylic acids, fatty acid esters, oils, alkoxylated compounds, silicone surfactants, ethers, and combinations thereof) can also influence the ease in which the liquid can flow into and/or out of the pores, thereby causing a hysteresis effect in the volume/pressure curves when loading and unloading the NMF fluids: FIGS. 8*a* through 8*f* illustrate sorption curves of various combinations of nanoporous materials and liquid components according to exemplary embodiments of the present invention.

Figure 8A:
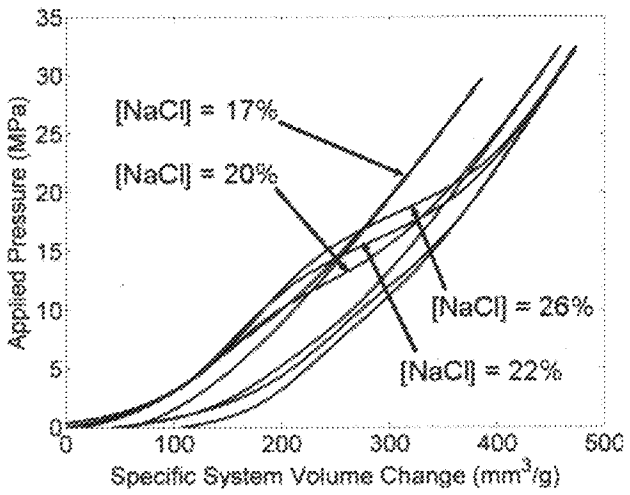
FIG. 8*a* is a graph comparing sorption isotherm curves for zeolite based NMF fluids including a solution of NaCl at a variety of concentrations according to one embodiment of the present invention.

FIG. 8*a* is a graph comparing sorption isotherm curves for zeolite based NMF fluids including a solution of NaCl and a zeolite at a variety of concentrations according to one embodiment of the present invention.

Figure 8B:
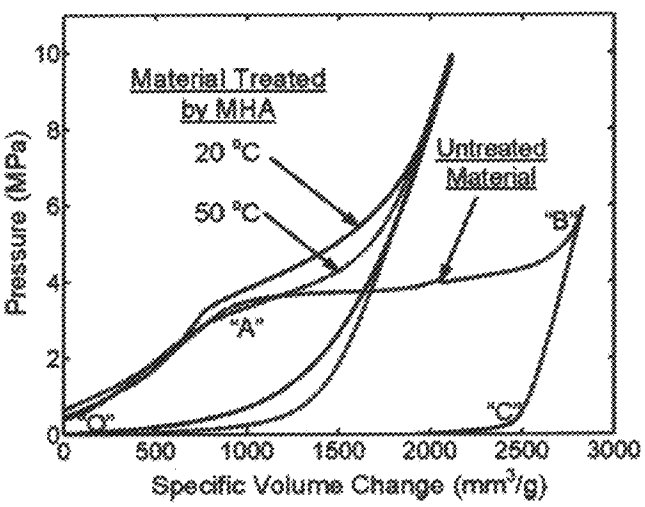
FIG. 8*b* is a graph comparing sorption isotherm curves for carbon based NMF fluids in which the carbon surface treating carbon surfaces with mercaptohexadecanoic acid (MHA) according to one embodiment of the present invention.

FIG. 8*b* is a graph comparing sorption isotherm curves for carbon based NMF fluids in which the carbon surfaces are treated with mercaptohexadecanoic acid (MHA) according to one embodiment of the present invention.

Figure 8C:
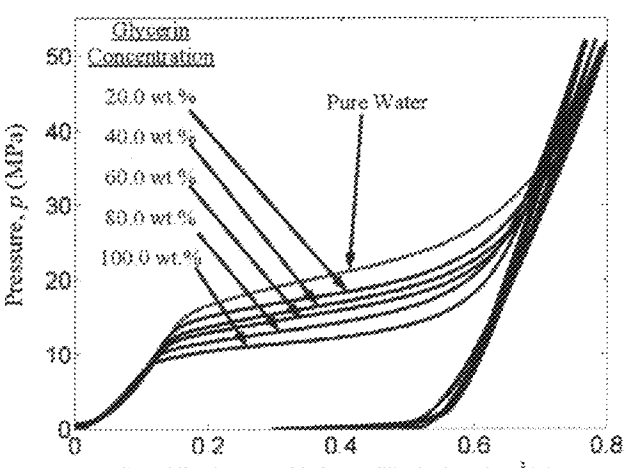
FIG. 8*c* is a graph comparing sorption isotherm curves of a silica based NMF fluid in glycerin-water mixtures having a variety of concentrations of glycerin according to one embodiment of the present invention.

FIG. 8*c* is a graph comparing sorption isotherm curves of a silica based NMF fluid in glycerin-water mixtures having a variety of concentrations of glycerin according to one embodiment of the present invention.

Figure 8D:
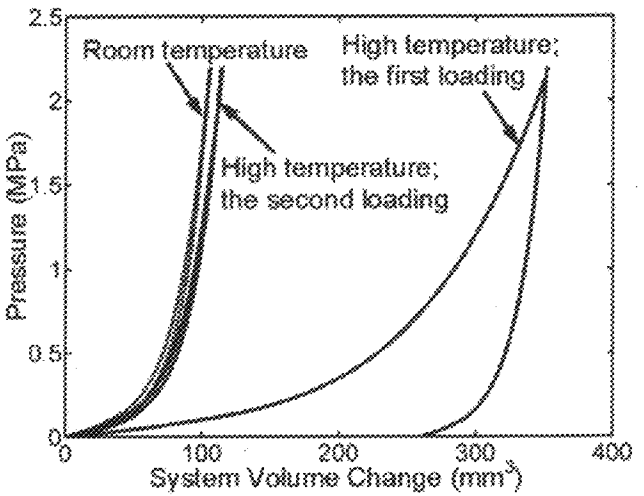
FIG. 8*d* is a graph comparing sorption isotherm curves of a nanoporous carbon in polypropylene during first and second loadings according to one embodiment of the present invention.

FIG. 8*d* is a graph comparing sorption isotherm curves of a nanoporous carbon in polypropylene during first and second loadings according to one embodiment of the present invention.

Figure 8F:
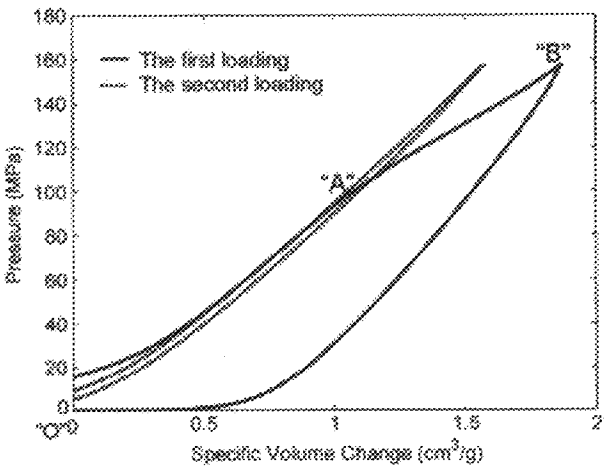
FIG. 8*f* is a graph comparing sorption isotherm curves of a carbon based NMF fluid in mercury during first and second loadings according to one embodiment of the present invention.
Figure 8E:
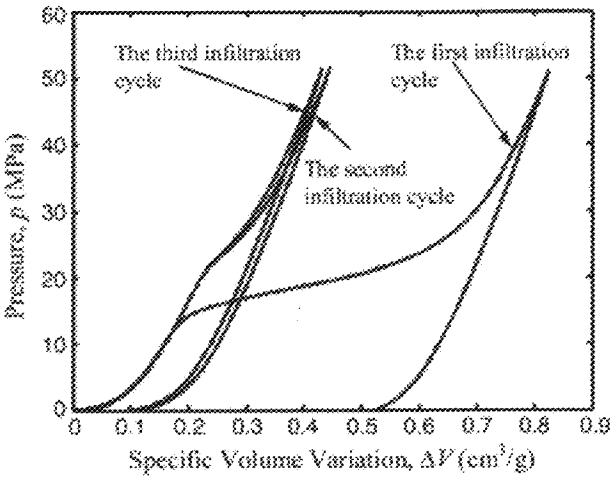
FIG. 8*e* is a graph comparing sorption isotherm curves of a silica based gel matrix NMF fluid during successive infiltration cycles according to one embodiment of the present invention.

FIG. 8*e* is a graph comparing sorption isotherm curves of a silica based gel matrix NMF fluid during successive infiltration cycles according to one embodiment of the present invention.

FIG. 8*f* is a graph comparing sorption isotherm curves of a carbon based NMF fluid in mercury during first and second loadings according to one embodiment of the present invention.

Figure 8G:
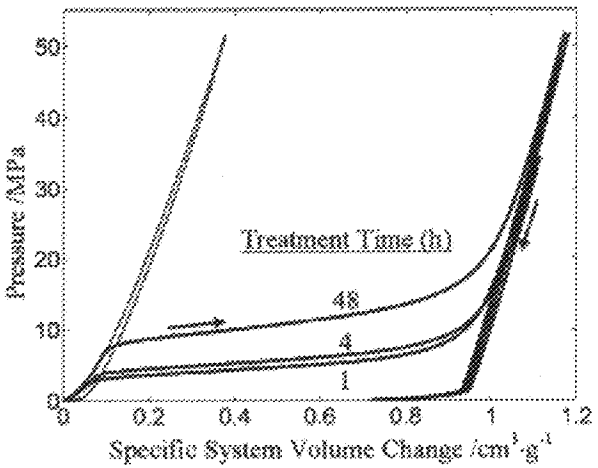
FIG. 8*g* is a graph comparing sorption isotherm curves of a silica based NMF fluid in which the silica particles have been treated for various amounts of time according to one embodiment of the present invention.

FIG. 8*g* is a graph comparing sorption isotherm curves of a silica based NMF fluid in which the silica particles have been treated for various amounts of time according to one embodiment of the present invention.

According to an embodiment of the present invention, NMF fluids provide a number of benefits, including:

(1) absorbing between 10 and 150 J/g in a single loading cycle, and efficiently lowering the overpressure plateau of a blast wave;

(2) repeatedly absorbing energy under cyclic loadings. Repeated energy absorption is attractive to dissipate multiple blast waves, e.g. generated by reflection of the initial blast wave at interfaces;

(3) responding to external forces at high speeds (e.g., a few microseconds). Impact and blast tests have indicated that the liquid infiltration mechanism will work within a few microseconds, which is suitable for blast loading conditions. The small length scale associated with liquid infiltration in nanopores contributes to this ultrafast response to a blast load. Thus, the blast wave peak can be lowered and the blast wave front can be reduced to a slowly rising, non-shock front;

(4) significantly improving the uniformity of the wave pressure delivered to the entire material system, thereby triggering a global response to local attacks and reducing damage localization (e.g., spreading the external force over a larger area of the structure);

(5) tailoring the buckling modes of the hollow tubes of the micro-truss structure, promoting more effective energy absorbing paths and more uniform deformation paths;

(6) exhibiting shear thickening liquid (STL) properties (e.g. a granular composite with a relatively soft or low-melting point $T_n$, matrix and porous grains), thereby promoting STL type energy management mechanisms in addition to the benefits listed above;

(7) having relatively low density (~0.8-0.9 g/cm$^3$) and therefore being suitable for lightweight systems; and (8) having low-cost potential, because the constituents—host liquid and nanoporous materials—can be manufactured cost efficiently and at large scales.

Figure 9:
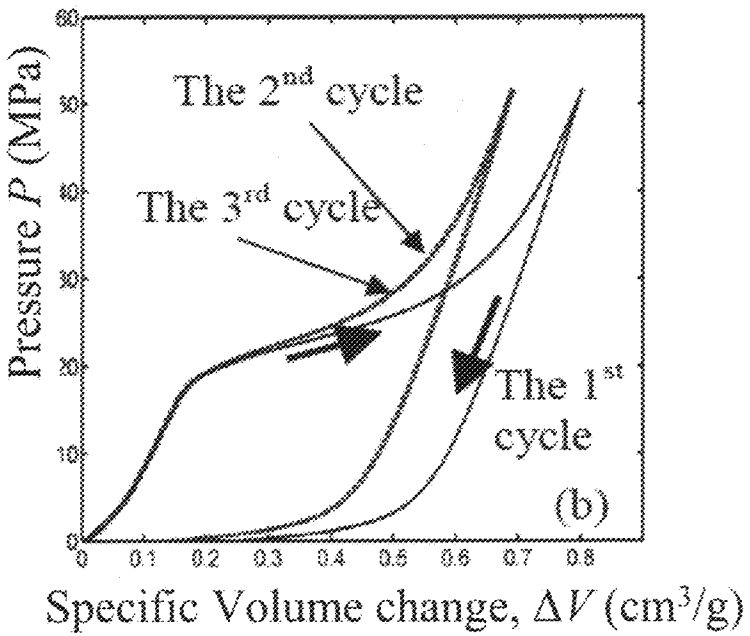
FIG. 9 is a graph illustrating a relationship between pressure and specific volume change for an NMF fluid during a plurality of cycles according to one embodiment of the present invention.

NMF fluids have been relatively well characterized through a series of quasi-static (FIG. 9), drop tower, and gas gun tests.

Figure 10A:
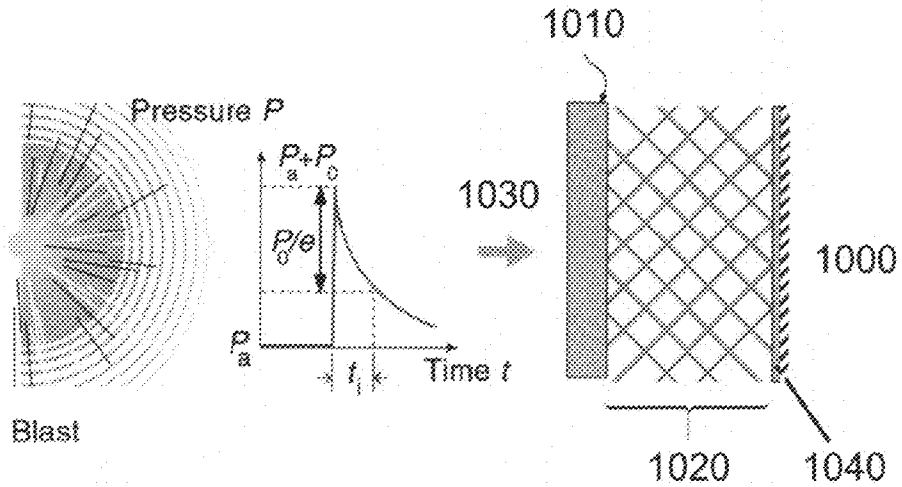
FIGS. 10*a* and 10*b* illustrate the effect of a blast on a micro-truss structure according to one embodiment of the present invention (figure adapted from A. G. Evans, M. Y. He, V. S. Deshpande, J. W. Hutchinson, A. J. Jacobsen, W. B. Carter, "Concepts for enhanced energy absorption using hollow micro-lattices," Int. Journal of Impact Engineering 37 (9), p. 947-959 (2010)).

According to one embodiment of the present invention, referring to FIG. 10*a*, an armor plate (or buffer mass) 1010 having mass $m_p$ can be attached to an outward facing surface of the above described fluidic micro-truss structure 1020 in order to rectify the blast (e.g., change the effective direction of off-angle forces to a direction normal to the armor plate) and protect a structure (or person) 1000 against projectile fragments. When a shock front arrives at the armor plate 1010, the armor plate acquires a momentum $m_p v$ in accordance with the energy of the shock front 1030. The kinetic energy associated with the armor plate 1010 is then dissipated by the fluidic micro-truss structure 1020 which undergoes plastic deformation or is stored elastically in micro-truss structure 1020.

Figure 11:
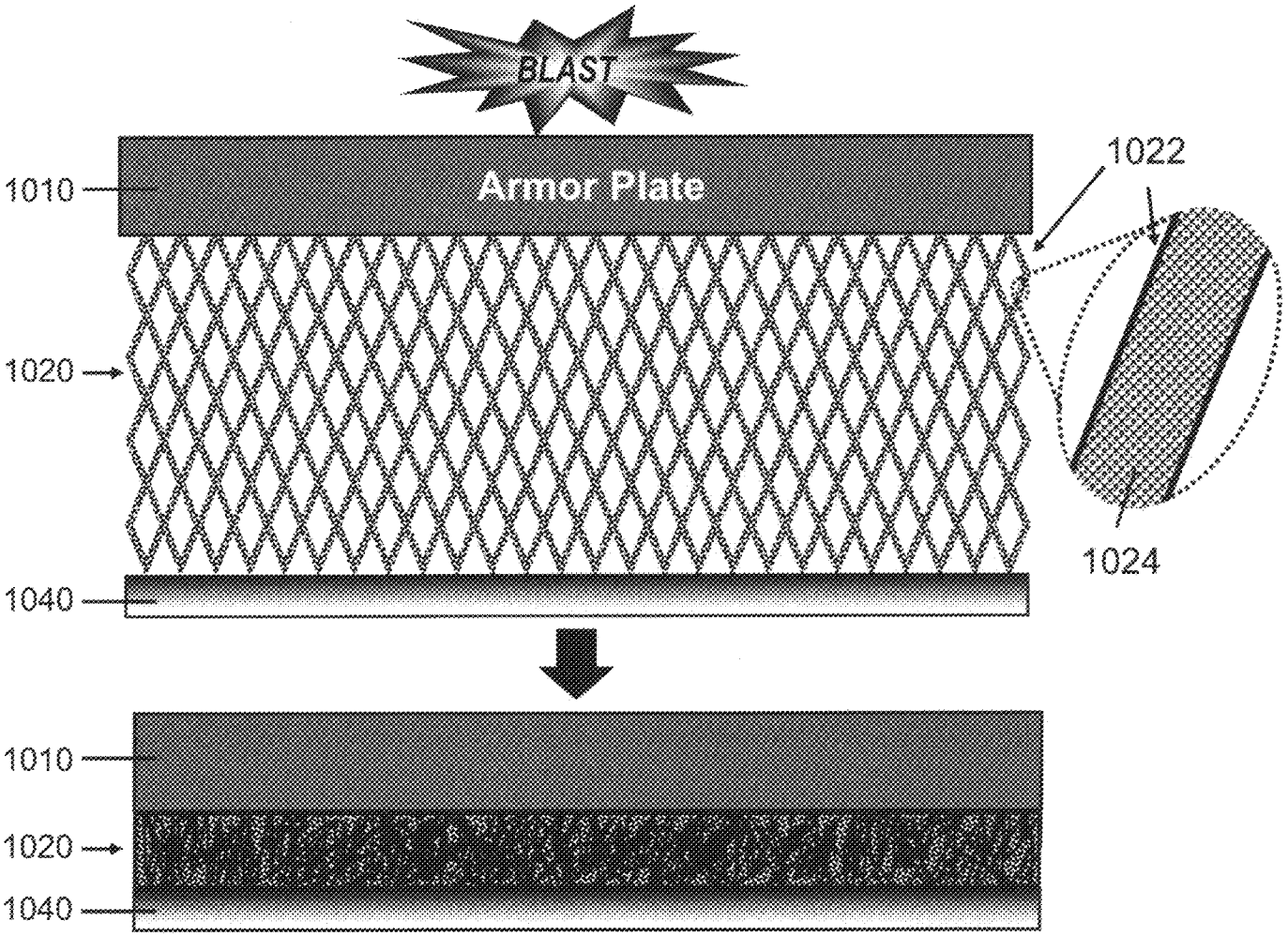
FIG. 11 illustrates the effect the effect of a blast on a fluidic micro-truss structure in which an NMF fluid is located within hollow struts of the micro-truss structure according to one embodiment of the present invention.

Referring to FIG. 11, according to one embodiment of the present invention, the hollow portions of the struts 1022 are filled with an NMF fluid 1024 in order to suppress buckling, increase the peak stress, and maintain a high plateau stress during compression. Facesheets 1040 attached to the micro-truss structure 1020 at the ends of the struts 1022 by brazing, soldering, or adhesive bonding (e.g., using epoxy), can contain the NMF fluid 1024 within the micro-truss structure 1020. Similarly, according to embodiments of the present invention, the armor plate 1010 attached to the ends of the struts 1020 opposite the end of the struts 1020 attached to the facesheet 1040 also contribute to containing the NMF fluid in the micro-truss structure 1020. Vacuum assisted infiltration can be employed to assist in filling the hollow trusses with the NMF fluid 1024.

A micro-truss structure loaded in uniaxial compression exhibits a strength given by $\sigma_{comp}=\sigma_{lim,truss}\bar{\rho}\sin^2\theta$, where $\bar{\rho}$ is relative density, $\theta$ is the truss angle, and $\sigma_{lim,truss}$ is the compressive strength of a strut determined by either buckling or yielding. Filling hollow tubes with NMF fluid has been shown to suppress buckling and increase the peak stress by ~30% as compared to empty struts, while maintaining a high stress level during deformation and thereby increasing energy absorption.

Figure 10B:
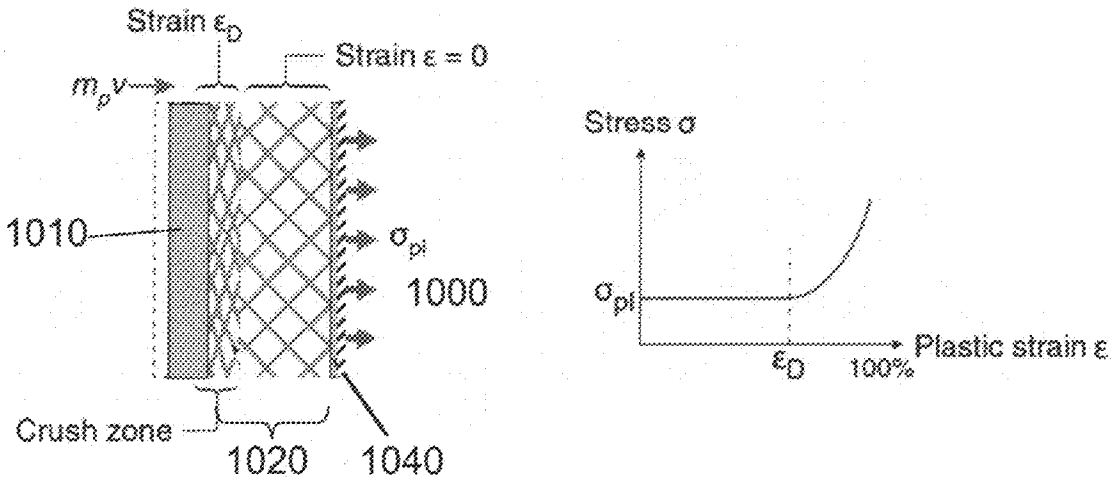

According to one embodiment of the present invention, a micro-truss structure 1020 with a mixture of 60° and 90° struts can maintain a plateau stress of a $\partial_{pl} \approx 1.3\bar{\rho}\sigma_Y$, where $\sigma_Y$ is the yield strength of the micro-truss structure during deformation by filling an NMF fluid into the hollow struts 1022 and considering the contributions from strain hardening. Assuming ideal plateau-like mechanical response as illustrated, for example, in FIG. 10*b*, characterized by a constant crushing stress $\sigma_{pl}$, with strain at densification $\epsilon_D$, the energy absorption per unit mass can be calculated by the equation: $U_m = \sigma_{pl}\epsilon_D/\bar{\rho}\rho_S$.

Figure 12:
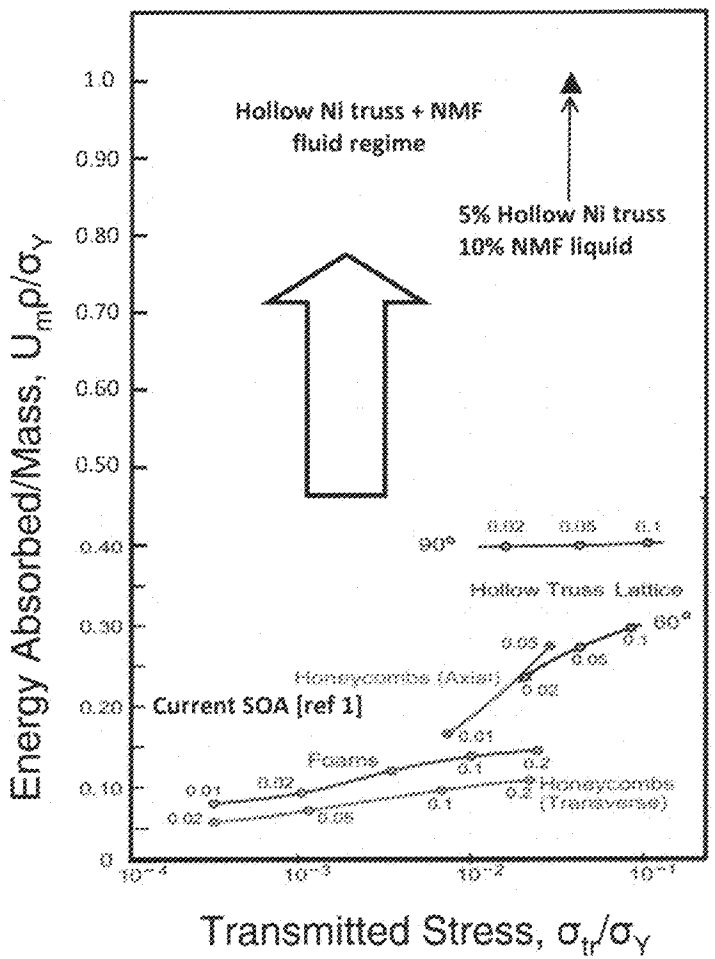
FIG. 12 is a graph comparing the energy absorbed per unit mass versus transmitted stress for a variety of energy absorbing materials in a non-dimensional form that distinguishes topology effects from the influence of material properties. The projected best performance of a fluidic micro-truss structure according to one envisioned embodiment of the present invention is included. (Figure adapted from A. G. Evans, M. Y. He, V. S. Deshpande, J. W. Hutchinson, A. J. Jacobsen, W. B. Carter, "Concepts for enhanced energy absorption using hollow micro-lattices," Int. Journal of Impact Engineering 37 (9), p. 947-959 (2010).)

FIG. 12 presents the energy absorbed versus transmitted stress of fluidic micro-truss structures according to an embodiment of the present invention as compared to other cellular materials in a non-dimensional form that distinguishes topology effects from the influence of material properties. For fluidic micro-truss structures according to embodiments in which the NMF fluid is located within the hollow portions of the struts, the energy absorbed and transmitted stress would scale as:

$$U_m \frac{\rho_S}{\sigma_Y} = 1.3\varepsilon_D\bar{\rho}\rho_S/(\bar{\rho}\rho_S + \bar{\rho}_{NMF}\rho_{NMF})$$

and $\sigma_{tr}/\sigma_Y = 1.3\bar{\rho}$, respectively.

For example, according to an envisioned embodiment of the present invention, a fluidic micro-truss structure comprised of nickel (having a density of 8.9 g/cm$^3$) hollow micro-truss with 5% relative density and the hollow truss members filled with NMF fluid (having a density of 0.8 g/cm$^3$) constituting 10% volume fraction, would exhibit a total density of 0.53 g/cm$^3$. Because the NMF fluid can undergo strains of up to 60% and can effectively fill voids in the crushed micro-truss structure, simulations indicate that a high densification strain (e.g., 90%) can be reached, resulting in a non-dimensional energy absorbed of 1.0 and transmitted stress of 0.06.

According to another envisioned embodiment of the present invention, a fluidic micro-truss structure includes an aqueous suspension of 40% by weight hydrophobic nanoporous silica gel filled inside the hollow struts of a metallic (e.g., electroplated nickel) micro-truss structure with a truss diameter of 2 mm, a wall thickness of 0.1 mm, a unit cell height of 15 mm, and in which metal fills 5% of total volume and liquid fills 25% of total volume.

According to still another envisioned embodiment of the present invention, a fluidic micro-truss structure includes a suspension of 7% by weight hydrophobic nanoporous silica gel in water filled in the open volume between the hollow struts of a metallic (e.g., electroplated nickel) micro-truss structure with a truss diameter of 1 mm, a wall thickness of 0.1 mm, a unit cell height of 10 mm, and in which metal fills 5% of total volume and liquid fills 85% of total volume.

According to a further envisioned embodiment of the present invention, a fluidic micro-truss structure includes a suspension of 7% by weight hydrophobic nanoporous silica gel in polyacrylic acid gel combined with a hollow micro-truss as described in the above envisioned embodiments of the present invention.

According to yet another embodiment of the present invention, multiple structures as in the envisioned embodiments described above are stacked to a structure having a thickness in the range of 3 cm to 10 cm.

Fluidic micro-truss structures according to embodiments in which the hollow struts of the micro-truss structure are filled with an NMF fluid are capable of absorbing 3 to 10 times more energy per unit mass than the current state of the art in cellular materials (e.g., the curves shown for transverse honeycombs, foams and axial honeycombs) as shown in FIG. 12.

In addition, according to embodiments of the present invention, energy spreading mechanisms may also further reduce the transmitted stress. The non-dimensional energy absorbed translates to 90 J/g for an embodiment in which the micro-truss structure includes electroplated nano-crystalline nickel with a yield strength of 800 MPa or >150 J/g for an embodiment in which a micro-truss structure includes aluminum alloys, e.g. A1 7076 T6 ($\sigma_Y$=420 MPa).

According to one embodiment of the present invention, the minimum thickness $h_{min}$ of the fluidic micro-truss structure for dissipating the energy of a blast having energy per unit area $M^2/2\ m_b$ can be calculated following: $h_{min} = M^2/2\ m_b * \sigma_{pl} * \epsilon_D$. If the actual thickness h, exceeds $h_{min}$, the pressure imparted to the structure does not exceed $\sigma_{pl}$. Accordingly, by choosing $\sigma_{pl} < \sigma_{th}$ the structure is protected. When $h < h_{min}$, the medium fully densifies before the buffer can absorb all of the blast energy and much larger pressures are transmitted when the buffer (e.g., an outward facing armor plate) "slaps" into the structure (e.g., the surface on the opposite side of the fluidic micro-truss structure). According to one embodiment of the present invention, when simulating the effect of a 20 kPa*sec blast impulse for $m_b$=50 kg/m$^2$, $\epsilon_D$=0.9 and $\sigma_Y$=800 MPa applied to a fluidic micro-truss composed of electroplated nano-crystalline nickel and NMF fluid, the minimum thickness of the fluidic micro-truss is about 0.2 m with a relative density of 2% and the minimum thickness is about 0.1 m when the relative density of the micro-truss structure is 5%. As a comparison, A1 7076 T6 honeycombs at a relative density of 5% ($\sigma_Y$=300 MPa) have a minimum thickness of about 0.7 m. Therefore, a fluidic micro-truss structure provides a greater than 5× reduction in thickness at similar levels of protection. Similarly, the required areal density of a fluidic micro-truss with a relative density of 5% is about 3× smaller than the areal density of A1 7076 T6 honeycombs at a relative density of 5%, resulting in a significantly lighter structure at similar levels of protection. Shock physics and inertial effects were not considered in this case, because the initial velocity of the buffer plate would be in the range of 200 to 400 m/s for blast impulses in the range of 10 to 20 kPa*sec.

Figure 13:
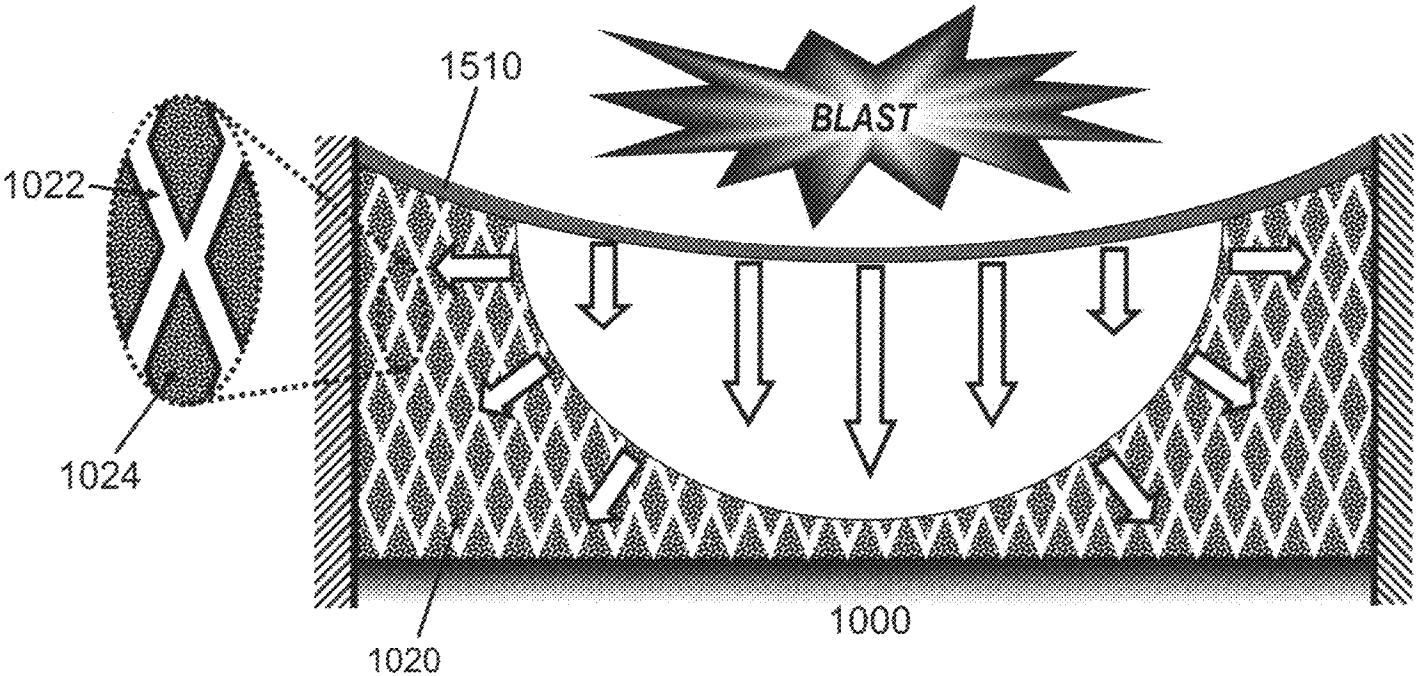
FIG. 13 illustrates the effect of a blast on a fluidic micro-truss structure in which an NMF fluid is located between the struts of the micro-truss structure according to one embodiment of the present invention.

As illustrated in FIG. 13, according to another embodiment of the present invention, the NMF fluid 1024 is inserted into the open space between the struts 1022 of the micro-truss structure. Gravity assisted infiltration can be used to fill the open space with NMF fluid, without the assistance of a vacuum. According to one embodiment of the present invention, a thin metallic face sheet 1510 is attached to the outward facing surface of the micro-truss structure.

Figure 14:
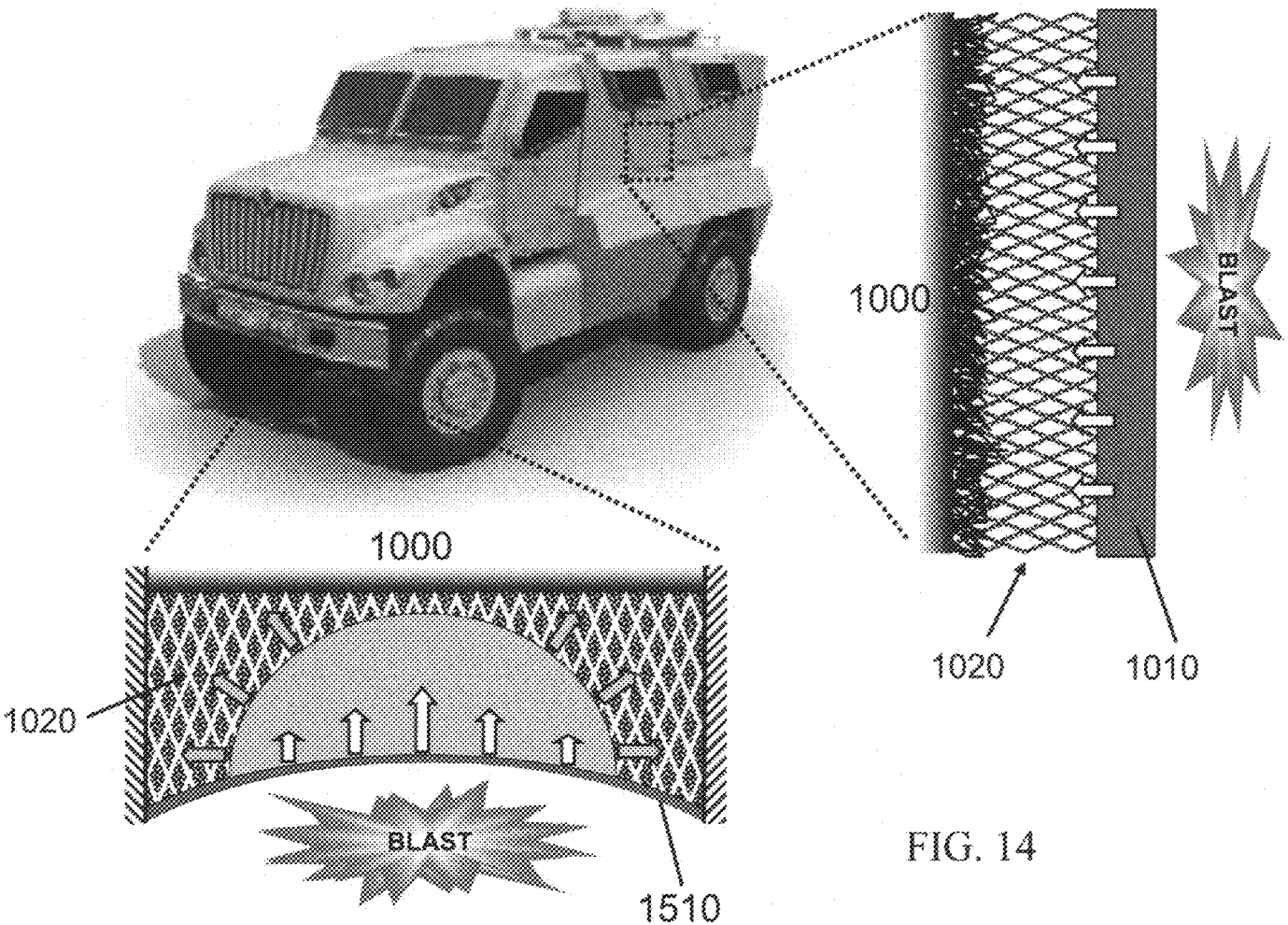
FIG. 14 illustrates an application of a fluidic micro-truss structure according to one embodiment of the present invention in which the fluidic micro-truss structure is used to provide blast protection for a vehicle.

According to one embodiment of the present invention, the fluidic micro-truss structure may be used as a component in vehicle armor. For example, as illustrated in FIG. 14, a fluidic micro-truss structure with an armor plate may be applied to the outer walls of a vehicle in order to provide protection against an external blast (e.g., from an IED or grenade) or impact from projectiles (e.g., shrapnel, mortars, bullets). In one embodiment of the present invention, a lighter weight fluidic micro-truss structure in which the NMF fluid is contained in the hollow portions of the struts is attached to the outer walls while a heavier fluidic micro-truss structure in which the NMF fluid is located in the space between the trusses is attached to the underside of the vehicle.

Similarly, in still another embodiment of the present invention, the fluidic micro-truss structure may be attached to outer surfaces of walls (e.g., of walls or other protective barrier) to protect those inside from external forces.

According to another embodiment of the present invention, the fluidic micro-truss structure is attached to protective armor (e.g., a bulletproof vest) and provides protection for the wearer against blast energy and impacts from projectiles.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A kinetic energy and blast energy absorbing material comprising:

a micro-truss structure comprising:

a plurality of first struts extending along a first direction;

a plurality of second struts extending along a second direction; and a plurality of third struts extending along a third direction; and a compressible fluid comprising a liquid or gel and a nanoporous material, wherein the micro-truss structure contains the compressible fluid.

2. The kinetic energy and blast energy absorbing material of claim 1, wherein the compressible fluid is a compressible nano-porous materials functionalized (NMF) fluid.

3. The kinetic energy and blast energy absorbing material of claim 2, wherein the compressible NMF fluid is in a liquid or gel form.

4. The kinetic energy and blast energy absorbing material of claim 2, wherein the liquid or gel is:

an infiltration fluid, wherein the infiltration fluid is nonwetting to the nanoporous material.

5. The kinetic energy and blast energy absorbing material of claim 4, wherein the nanoporous material is a silica based hydrophobic nanoporous material.

6. The kinetic energy and blast energy absorbing material of claim 4, wherein the nanoporous material is a hydrophobic zeolite.

7. The kinetic energy and blast energy absorbing material of claim 4, wherein the nanoporous material is a nanoporous carbon.

8. The kinetic energy and blast energy absorbing material of claim 7, wherein the nanoporous carbon is a mercapto-hexadecanoic acid (MHA) treated nanoporous carbon.

9. The kinetic energy and blast energy absorbing material of claim 4, wherein the nanoporous material has a surface area at 100 $m^2/g$ or 2000 $m^2/g$ or between 100 $m^2/g$ and 2000 $m^2/g$.

10. The kinetic energy and blast energy absorbing material of claim 4, wherein the infiltration fluid comprises water, an aqueous solution of electrolytes, a viscous liquid, a liquid metal, a gel, a polymer, or a combination thereof.

11. The kinetic energy and blast energy absorbing material of claim 1 further comprising an armor plate attached to a plurality of second ends of the plurality of first, second, and third struts.

12. The kinetic energy and blast energy absorbing material of claim 11, wherein the kinetic energy and blast energy absorbing material is configured to be a part of a vehicle with the armor plate on an outward facing portion of the vehicle.

13. The kinetic energy and blast energy absorbing material of claim 1, wherein the struts are hollow.

14. The kinetic energy and blast energy absorbing material of claim 13, wherein the compressible fluid is located within the hollow struts.

15. The kinetic energy and blast energy absorbing material of claim 13, wherein each of the struts has an inner diameter from 10 microns to 10 mm.

16. The kinetic energy and blast energy absorbing material of claim 13 wherein a wall of each of the struts has a thickness from 1 micron to 1 millimeter.

17. The kinetic energy and blast energy absorbing material of claim 1, wherein the compressible fluid is located between the struts.

18. The kinetic energy and blast energy absorbing material of claim 1, wherein the kinetic energy and blast energy absorbing material is configured to be a part of a protective piece of clothing.

19. The kinetic energy and blast energy absorbing material of claim 1, wherein the kinetic energy and blast energy absorbing material is configured to be a part of a wall of a building.

20. The kinetic energy and blast energy absorbing material of claim 1, wherein the first, second, and third struts comprise a metal.

21. The kinetic energy and blast energy absorbing material of claim 20, wherein the metal is nickel, aluminum, titanium, steel, or alloys thereof.

22. The kinetic energy and blast energy absorbing material of claim 1, wherein the struts comprise a polymer.

23. The kinetic energy and blast energy absorbing material of claim 22, wherein the polymer is a polycarbonate, an aramid, a high impact polystyrene, a nylon, an ultra-high molecular weight polyethylene, and combinations thereof.

24. The kinetic energy and blast energy absorbing material of claim 1, wherein the micro-truss structure fills 0.5% to 30% of a volume of the material and wherein the compressible fluid fills 5% to 95% of the volume.

25. The kinetic energy and blast energy absorbing material of claim 1, wherein each of the first, second, and third directions is at an angle between 45° and 70° with respect to a facesheet attached to a plurality of first ends of the first, second, and third struts.

26. The kinetic energy and blast energy absorbing material of claim 1 further comprising a plurality of fourth struts extending in a fourth direction substantially perpendicular with respect to a facesheet attached to a plurality of first ends of the first, second, and third struts.

27. The kinetic energy and blast energy absorbing material of claim 26, wherein the plurality of first, second, third and fourth struts are hollow and comprise metal and the first, second, third and fourth struts each have a diameter of 2 mm and a wall thickness of 0.1 mm, wherein the micro-truss structure has a unit cell height of 15 mm, wherein each of the first, second, and third directions is at an angle of 60° with respect to the facesheet, wherein the compressible fluid is an aqueous suspension of 40% by weight hydrophobic nanoporous silica gel in water and is located within the hollow portions of plurality of first, second, and third struts, and wherein the micro-truss structure fills 5% of the volume of the kinetic energy and blast energy absorbing material and the compressible fluid fills 25% of the volume of the kinetic energy and blast energy absorbing material.

28. The kinetic energy and blast energy absorbing material of claim 26, wherein the plurality of first, second, third and fourth struts are, hollow and comprise metal and the first, second, third and fourth struts each have a diameter of 2 mm and a wall thickness of 0.1 mm, wherein the micro-truss structure has a unit cell height of 15 mm, wherein each of the first, second, and third directions is at an angle of 60° with respect to the facesheet, wherein the compressible fluid is an aqueous suspension of 7% by weight hydrophobic nanoporous silica gel in polyacrylic acid gel and is located within the hollow portions of plurality of first, second, and third struts, and wherein the micro-truss structure fills 5% of the volume of the kinetic energy and blast energy absorbing material and the compressible fluid fills 25% of the volume of the kinetic energy and blast energy absorbing material.

29. The kinetic energy and blast energy absorbing material of claim 26, wherein the plurality of first, second, third and fourth struts are hollow and comprise metal and the first, second, third and fourth struts each have a diameter of 1 mm and a wall thickness of 0.1 mm, wherein the micro-truss structure has a unit cell height of 10 mm, wherein each of the first, second, and third directions is at an angle of 60° with respect to the facesheet, wherein the compressible fluid is an aqueous suspension of 7% by weight hydrophobic nanoporous silica gel in water and is located within the open volume between the struts, and wherein the micro-truss structure fills 5% of the volume of the kinetic energy and blast energy absorbing material and the compressible fluid fills 85% of the volume of the kinetic energy and blast energy absorbing material.

30. The kinetic energy and blast energy absorbing material of claim 26, wherein the plurality of first, second, third and fourth struts are hollow and comprise metal and the first, second, third and fourth struts each have a diameter of 1 mm and a wall thickness of 0.1 mm, wherein the micro-truss structure has a unit cell height of 10 mm, wherein each of the first, second, and third directions is at an angle of 60° with respect to the facesheet, wherein the compressible fluid is an aqueous suspension of 7% by weight hydrophobic nanoporous silica gel in polyacrylic acid gel and is located within the open volume between the struts, and wherein the micro-truss structure fills 5% of the volume of the kinetic energy and blast energy absorbing material and the compressible fluid fills 85% of the volume of the kinetic energy and blast energy absorbing material.

* * * * *